US010951998B2

(12) United States Patent
Pooladian et al.

(10) Patent No.: US 10,951,998 B2
(45) **Date of Patent: *Mar. 16, 2021**

(54) ANTENNA WITH FLARED CROSS-FEED IN A HEARING ASSISTANCE DEVICE

(71) Applicant: Starkey Laboratories, Inc., Eden Prairie, MN (US)

(72) Inventors: Nasser Thomas Pooladian, Roseville, MN (US); Brent Anthony Bauman, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/503,231

(22) Filed: Jul. 3, 2019

(65) Prior Publication Data

US 2019/0327568 A1 Oct. 24, 2019

Related U.S. Application Data

(63) Continuation of application No. 15/246,357, filed on Aug. 24, 2016, now Pat. No. 10,349,192.

(60) Provisional application No. 62/211,249, filed on Aug. 28, 2015.

(51) Int. Cl.
*H04R 25/00* (2006.01)

(52) U.S. Cl.
CPC ..... *H04R 25/554* (2013.01); *H04R 25/558* (2013.01); *H04R 25/60* (2013.01); *H04R 25/65* (2013.01); *H04R 2225/021* (2013.01); *H04R 2225/51* (2013.01)

(58) Field of Classification Search
CPC .... H04R 25/554; H04R 25/558; H04R 25/65; H04R 2225/021; H04R 2225/51; H04R 2499/11; H04R 25/60; H01Q 1/273
USPC ..... 381/312, 315, 322, 330, 331; 379/443; 343/866
See application file for complete search history.

(56) References Cited

U.S. PATENT DOCUMENTS

| | | | | |
|---|---|---|---|---|
| 8,699,733 | B2 | 4/2014 | Polinske et al. | |
| 9,466,876 | B2 * | 10/2016 | Kerselaers | H01Q 1/273 |
| 10,349,192 | B2 | 7/2019 | Pooladian et al. | |
| 2014/0321685 | A1 | 10/2014 | Rabel | |
| 2015/0036854 | A1 | 2/2015 | Polinske et al. | |
| 2015/0049891 | A1 | 2/2015 | Johnson et al. | |
| 2017/0064466 | A1 | 3/2017 | Pooladian et al. | |

OTHER PUBLICATIONS

"U.S. Appl. No. 15/246,357, Advisory Action dated Jun. 26, 2018", 3 pgs.

(Continued)

*Primary Examiner* — Huyen D Le
(74) *Attorney, Agent, or Firm* — Schwegman Lundberg & Woessner, P.A.

(57) ABSTRACT

A hearing assistance device such as a hearing aid includes an antenna for wireless communication with another device. The antenna includes two antenna elements and a cross-feed that provides for electrical connection between the two antenna elements. The cross-feed having a flared structure configured to reduce an effect of head loading on the performance of the wireless communication by approximately minimizing capacitive coupling between the cross-feed and a wearer when the hearing assistance device is worn by the wearer.

20 Claims, 4 Drawing Sheets

(56) References Cited

OTHER PUBLICATIONS

"U.S. Appl. No. 15/246,357, Final Office Action dated Apr. 4, 2018", 10 pgs.
"U.S. Appl. No. 15/246,357, Non Final Office Action dated Aug. 3, 2018", 10 pgs.
"U.S. Appl. No. 15/246,357, Non Final Office Action dated Sep. 22, 2017", 9 pgs.
"U.S. Appl. No. 15/246,357, Notice of Allowance dated Feb. 28, 2019", 5 pgs.
"U.S. Appl. No. 15/246,357, Response Filed Jun. 1, 2018 to Final Office Action dated Apr. 4, 2018", 9 pgs.
"U.S. Appl. No. 15/246,357, Response filed Oct. 31, 2018 to Non Final Office Action dated Aug. 4, 2018", 11 pgs.
"U.S. Appl. No. 15/246,357, Response filed Dec. 11, 2017 to Non Final Office Action dated Sep. 22, 2017", 8 pgs.
"European Application Serial No. 16186004.4, Extended European Search Report dated Jan. 12, 2017", 7 pgs.

* cited by examiner

ANTENNA WITH FLARED CROSS-FEED IN A HEARING ASSISTANCE DEVICE

CLAIM OF PRIORITY

This patent application is a continuation of U.S. patent application Ser. No. 15/246,357, filed Aug. 24, 2016, now issued as U.S. Pat. No. 10,349,192, which claims the benefit of U.S. Provisional Patent Application No. 62/211,249, filed Aug. 28, 2015, entitled "ANTENNA WITH FLARED CROSS-FEED IN A HEARING ASSISTANCE DEVICE", each of which are incorporated by reference herein in their entirety.

TECHNICAL FIELD

This document relates generally to hearing assistance systems and more particularly to a hearing assistance device that includes an antenna configured for decreasing degradation in performance of wireless communication due to head loading when the hearing assistance device is worn.

BACKGROUND

Hearing assistance devices such as hearing aids are used to assist patients suffering hearing loss by transmitting amplified sounds to ear canals. The sounds may be detected from a patient's environment using the microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. The hearing aids may each include an antenna for the wireless communication. Due to the loading effect of the patient's body on the antenna, there is a need for optimizing performance of the wireless communication without increasing size and/or complexity of a hearing aid.

SUMMARY

A hearing assistance device such as a hearing aid includes an antenna for wireless communication with another device. The antenna includes two antenna elements and a cross-feed that provides for electrical connection between the two antenna elements. The cross-feed having a flared structure configured to reduce an effect of head loading on the performance of the wireless communication by approximately minimizing capacitive coupling between the cross-feed and a wearer when the hearing assistance device is worn by the wearer.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing assistance device, such as a hearing aid, with an antenna that is configured to reduce effects of "head loading" on performance of wireless communication. An antenna when placed next to the head of the wearer of the hearing assistance device (or any other dielectric object) will experience a shift in impedance. If this shift in impedance is too large for the antenna matching network of the hearing assistance device to account for at a certain frequency, the wireless communication at that frequency will either operate with degraded performance or become inoperable. Examples of solutions to this problem include adding more capacitor banks to make the matching network tunable and increasing spacing between the antenna and the wearer. However, such solutions increase the complexity, power consumption, size, and/or visibility of the hearing assistance device, none of which is desirable, especially when the hearing assistance device is a hearing aid.

The present subject matter provides an antenna configured for use in a hearing assistance device such as a hearing aid with reduced head loading, i.e., reduced shift in impedance when the hearing aid is placed on the wearer's head (e.g., in and/or around an ear). In various embodiments, the present subject matter can be implemented with limited modification of existing antenna configurations and limited or no modification of other parts of the hearing assistance device. While a loop antenna, particularly a "butterfly antenna" configuration for used in a behind-the-ear (BTE) type hearing aid is discussed as a specific example with reference to FIGS. 1-6, the approach to decreasing coupling between the antenna and the wearer's head as discussed in this document can be applied to other configurations of antenna used in other types of hearing assistance devices, including other types of hearing aids, without departing from the scope of the present subject matter.

Figure 1:
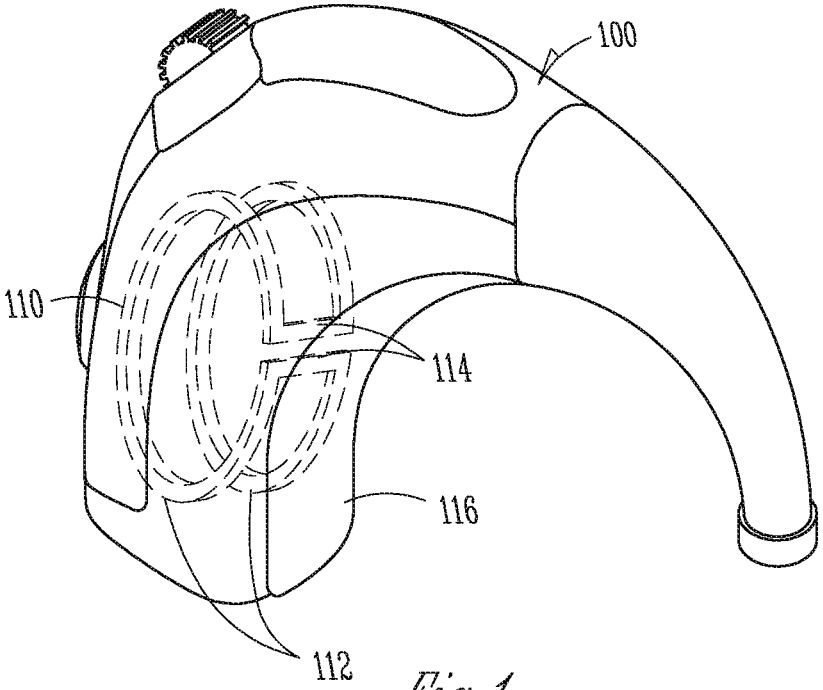
FIG. 1 is an illustration of an embodiment of a hearing aid including an antenna for wireless communication.

FIG. 1 is an illustration of an embodiment of a hearing aid 100 including an antenna 110 for wireless communication between hearing aid 100 and another device. In the illustrated embodiment, hearing aid 100 is a behind-the-ear (BTE) type hearing aid, and antenna 110 is a parallel-loop type antenna housed in a case 116 of hearing aid 100. While the BTE type hearing aid and the parallel-loop type antenna are illustrated as an example, the present subject matter is applicable to any type hearing aid or other hearing assistance device with an antenna of any type that may be affected by head loading when being worn by a person. Examples of antenna 110 include those discussed in U.S. patent application Ser. No. 12/638,720, entitled "PARALLEL ANTENNAS FOR STANDARD FIT HEARING ASSISTANCE DEVICES", filed on Dec. 15, 2009, published as US 2010/0158293, U.S. patent application Ser. No. 12/340,604, entitled "ANTENNAS FOR STANDARD FIT HEARING ASSISTANCE DEVICES", filed on Dec. 15, 2008, published as US 2010/0158291, U.S. patent application Ser. No. 12/340,600, entitled "ANTENNAS FOR CUSTOM FIT HEARING ASSISTANCE DEVICES", filed on Dec. 19, 2008, published as US 2010/0158295, and U.S. Pat. No. 7,593,538, entitled "ANTENNAS FOR HEARING AIDS", all assigned to Starkey Laboratories, Inc., which are incorporated herein by reference in their entirety.

Antenna 110 includes two antenna elements 112 and a cross-feed 114 that electrically connects antenna elements 112. In the illustrated embodiment, antenna elements 112 include two approximately symmetric antenna loops positioned in parallel on opposite sides of hearing aid 100. The two antenna loops comprise two small (relative to a wavelength of the operating frequency of the wireless communication) inductive loop antennas connected in parallel. This antenna inductance is then brought to parallel resonance by adding a resonating capacitor near the feed-point (where the two antenna loops are connected with the cross-feed). Cross-feed 114 includes two cross-feed lines each connected between the two antenna loops. In various embodiments, cross-feed 114 is configured to reduce or approximately minimize its capacitive coupling to the wearer, particularly the wearer's head and/or ear, when hearing aid 100 is being worn by the wearer.

Figure 2:
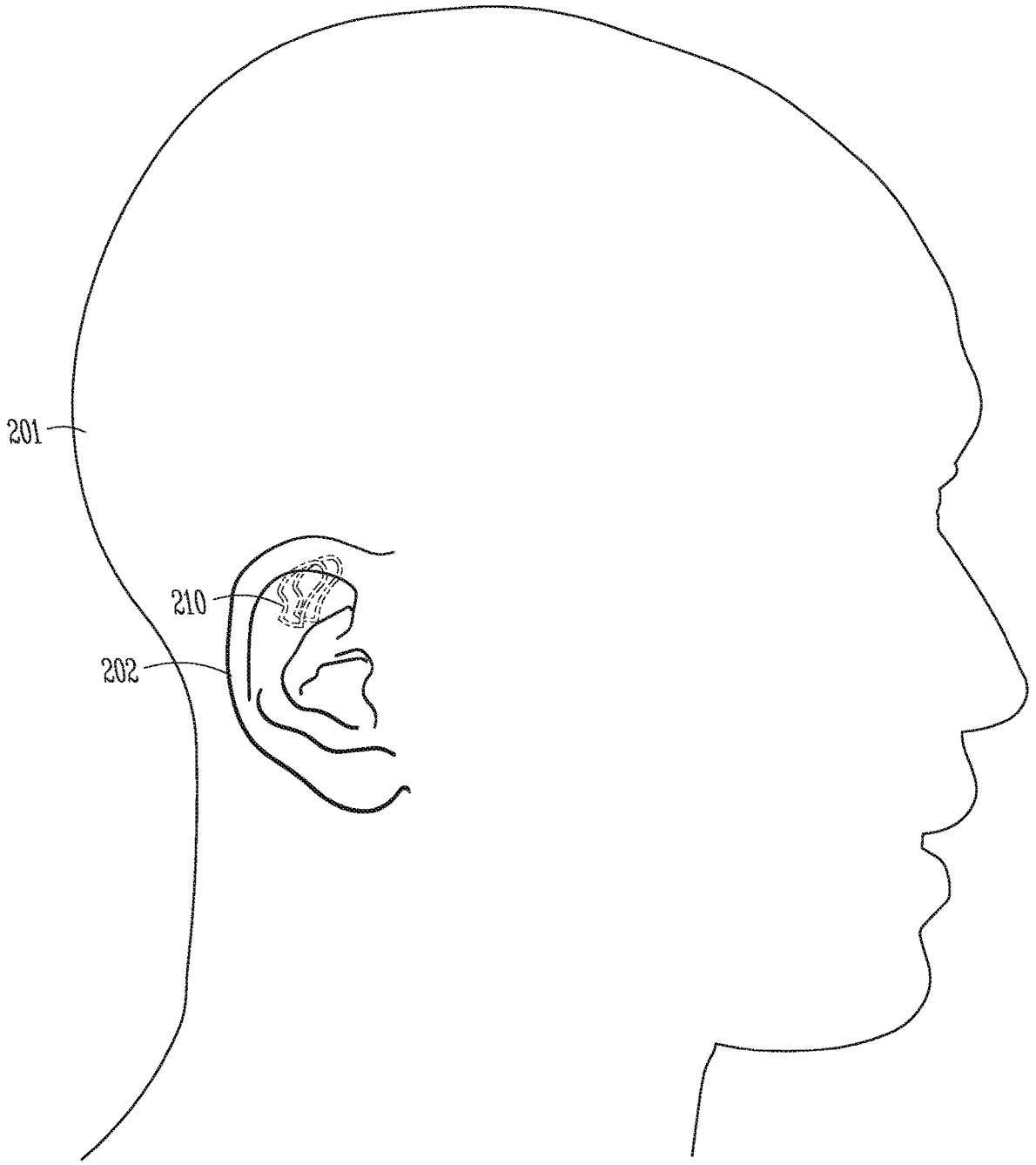
FIG. 2 is an illustration of an embodiment of the antenna showing its position relative to the head of the wearer of the hearing aid.

FIG. 2 is an illustration of an embodiment of an antenna 210 showing its position relative to a head 201 and an ear 202 of a hearing aid wearer when the hearing aid including antenna 210 is worn. Antenna 210 represents an embodiment of antenna 110 and has a configuration of a "butterfly antenna" as a specific example. FIG. 2 illustrates, as a specific example, the position of antenna 210 as a parallel-loop type antenna of a BTE type hearing aid when the hearing aid is worn by the hearing aid wearer.

When hearing aid 100 is worn by the wearer, and antenna 110 is positioned on the wearer's head/ear in a way similar to antenna 210 placed on head 201/ear 202 as illustrated in FIG. 2, the antenna conductors (conductors of antenna loops 112) near cross-feed 114 and cross-feed 114 itself are very sensitive to capacitive loading changes, when being compared to the portion of antenna 110 opposite the feed-point/cross-feed that is much less sensitive to the capacitive loading changes. Placing antenna 110 on the wearer's head causes a substantial shift in the tuning of the antenna's resonant frequency (i.e., the capacitive loading change) due to coupling between the human head/ear and the cross-feed/feed-point area of the antenna. In one example, a variable capacitor implemented near the feed-point automatically retunes the resonating capacitance value to maintain resonance at the frequency of operation. For this type of hearing aid design, this tuning shift when placing on the head is problematic in that it takes a significant portion of the tuning capacitance (over a third of the range), when most of the range is needed for operating frequency changes and compensating for production component variations. Additionally, increased coupling to the lossy human head/ear in this sensitive area of the antenna may also reduce gain/radiation efficiency when worn on the human head/ear.

Figure 3:
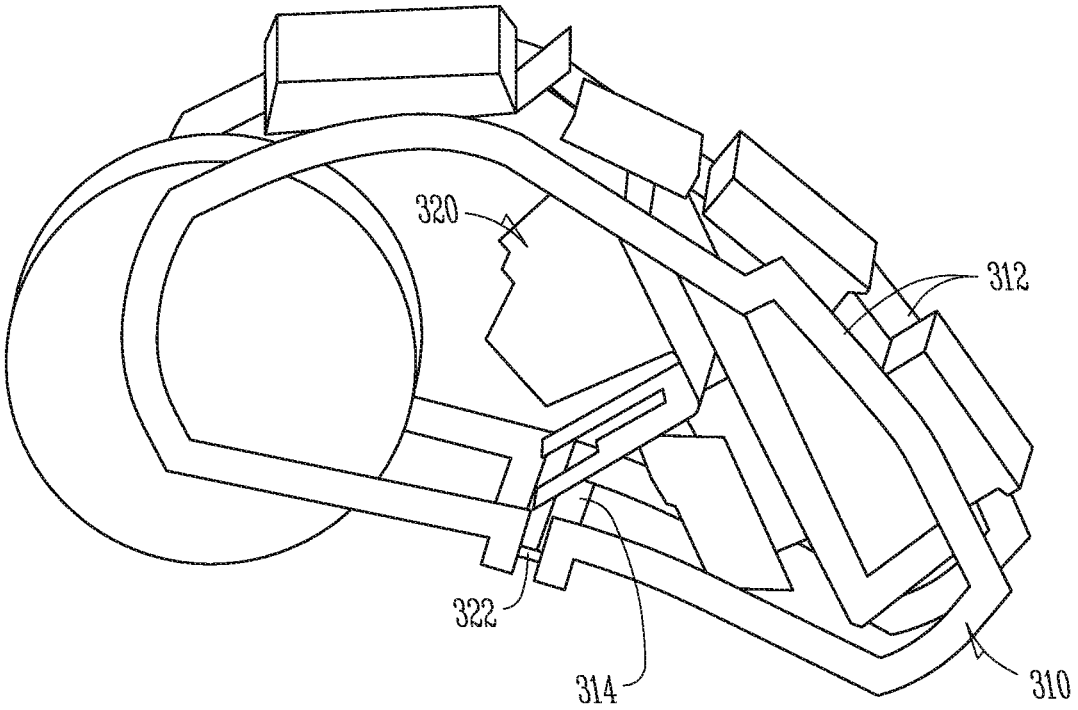
FIG. 3 is an illustration of an embodiment of portions of a hearing aid circuit including the antenna.
Figure 4:
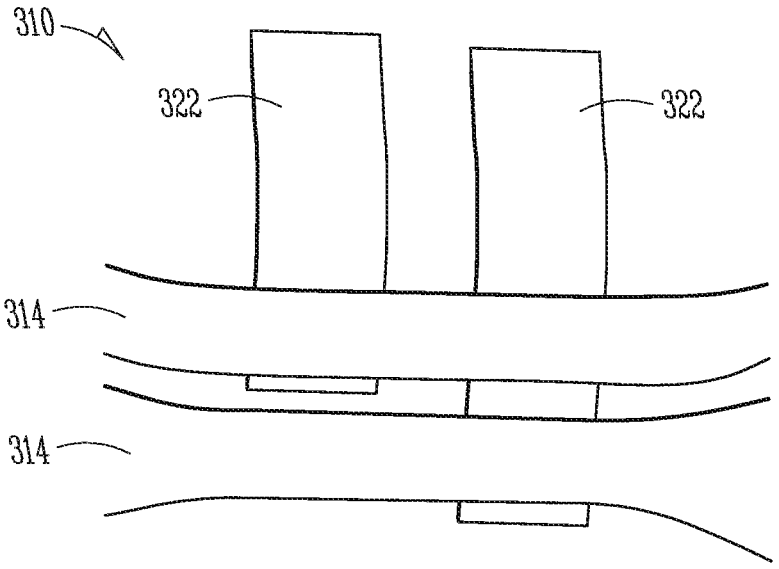
FIG. 4 is an illustration of an embodiment of a cross-feed of the antenna connected to a feed.

The present subject matter reduces the amount of shift in the tuning of the antenna's resonant frequency by decreasing coupling of the loop antennas cross-feed/feed-point area to the wearer's head/ear. FIG. 3 is an illustration of an embodiment of portions of a hearing aid circuit 320 including an antenna 310. Hearing aid circuit 320 represents an embodiment of a circuit of hearing aid 100 that is also housed in case 116. In various embodiments, hearing aid circuit 320 includes a microphone to receive an input sound, a processing circuit to produce an output signal by processing a signal received from the microphone, a receiver to produce an output sound using the output signal and transmits the output sounds to the ear canal of the wearer, and a communication circuit coupled to antenna 310 to perform wireless communication. Antenna 310 represents an embodiment of antenna 110 and has a configuration of the "butterfly antenna" (of the parallel-loop type) as a specific example. Antenna 310 as illustrated in FIG. 3 includes a conductor trace (such as copper trace) forming two antenna loops 312 and a cross-feed 314 coupled between antenna loops 312. In one embodiment, antenna 310 is a flex circuit antenna including the conductor trace on a flex circuit substrate. An example of such a flex circuit antenna is discussed in U.S. patent application Ser. No. 12/638,720, entitled "PARALLEL ANTENNAS FOR STANDARD FIT HEARING ASSISTANCE DEVICES", filed on Dec. 15, 2009, published as US 2010/0158293, assigned to Starkey Laboratories, Inc., which is incorporated herein by reference in its entirety. A feed 322 electrically connects cross-feed 314 (and hence antenna 310) to hearing aid circuit 320. FIG. 4 is an illustration of an embodiment of cross-feed 314 and feed 322 in a zoomed view. Cross-feed 314 represents an embodiment of cross-feed 114, In the illustrated embodiment, cross-feed 314 includes two cross-feed lines each connected between antenna loops 312, and feed 322 includes two feed lines each connected to a cross-feed line of cross-feed 314.

In some examples, portions of antenna 310 including cross-feed 314 and structures near cross-feed 314 that are normal to the wearer's head when the hearing aid is worn are limited to reduce the amount of shift in the tuning of the antenna's resonant frequency. That portion of the antenna is believed to be attributed to higher ear-to-ear communication performance due to the excitation of the mode across the head that is most easily excited through normal current distribution to the conductive surface of the wearer's head and skin. In various embodiments, the present subject matter flares the cross-feed before the feed point (where the two conductor trace are at closest distance from each other as illustrated) so that there is less coupling between cross-feed lines and less area for capacitive loading from the head and specifically the top of the ear of the wearer. In various embodiments, this requires small modifications to hearing aid antennas currently distributed in devices in the field, such as those similar to antenna 310. Such a small modification can significantly improve the performance of the wireless communication when head loading is a concern.

Figure 5:
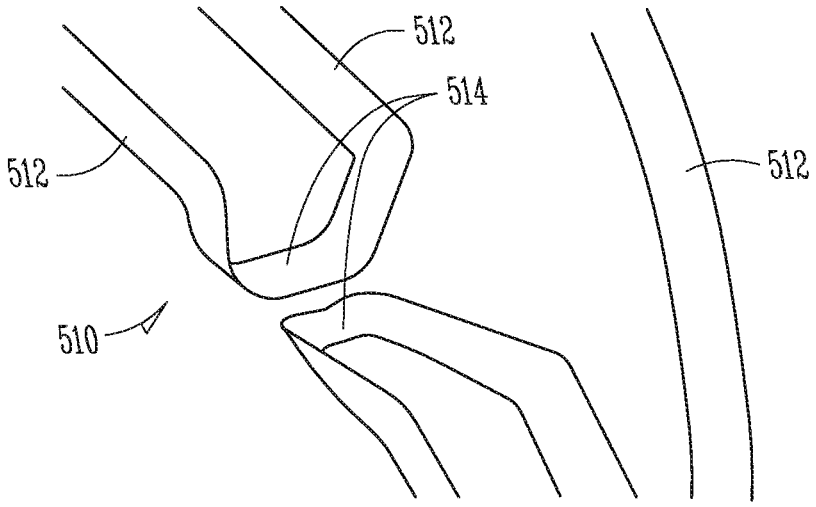
FIG. 5 is an illustration of an embodiment of a flared cross-feed of the antenna.

FIG. 5 is an illustration of an embodiment of a flared cross-feed 514 of an antenna 510. Antenna 510 represents an embodiment of antenna 110 and includes two antenna loops 512 and a cross-feed 514 that that electrically connects antenna loops 512. Antenna loops 512 represent an embodiment of antenna elements 112. Cross-feed 514 represents an embodiment of cross-feed 114 with its structure configured to reduce the amount of shift in the tuning of the resonant frequency of antenna 110 by decreasing coupling of the cross-feed/feed-point area of antenna 110 to the wearer's head/ear. In the illustrated embodiment, in which cross-feed 514 includes two cross-feed lines each coupled between antenna loops 512 and approximately perpendicular to each loop of antenna loops 512, this is accomplished by effectively mitering the corners of the approximately 90-degree bend in the structure of the cross-feed such as illustrated as cross-feed 314 in antenna 310 and a portion of antenna loop 312 to decrease capacitive coupling to the wearer's head/ear, by converting the approximately 90-degree bends (or turns) into two approximately 45-degree bends (or turns). This results in antenna 510 with a flared cross-feed 514. Antenna 510 has been shown to significantly reduce the shift in the tuning of the antenna's resonant frequency due to coupling between the wearer's head/ear and the cross-feed/feed-point area of the antenna. Additionally, it has been shown that reducing coupling from the cross-feed/feed-point area of antenna 514 to the "lossy" human head/ear also yields gain/efficiency improvement for the antenna when worn on the wearer's head/ear, for example when compared to antenna 314.

The approximately 90-degree bends and 45-degree bends are illustrated as specific examples rather than limitations of the present subject matter. In various embodiments, cross-feed 514 has a flared structure configured to approximately minimize capacitive coupling between cross-feed 514 and the wearer (primarily the head and/or the ear of the wearer). The flared structure includes cross-feed lines each having one or more bends. In various embodiments, the flared structure may include cross-feed 514 and portions of antenna loops 512. In the illustrated embodiment, the flared structure includes two lines (the two cross-feed lines and portions of the two antenna loops) each having two approximately 45-degree bends. In various embodiments, the flared structure includes two lines each include a plurality of bends with angles having a sum of approximately 90 degrees.

Figure 6:
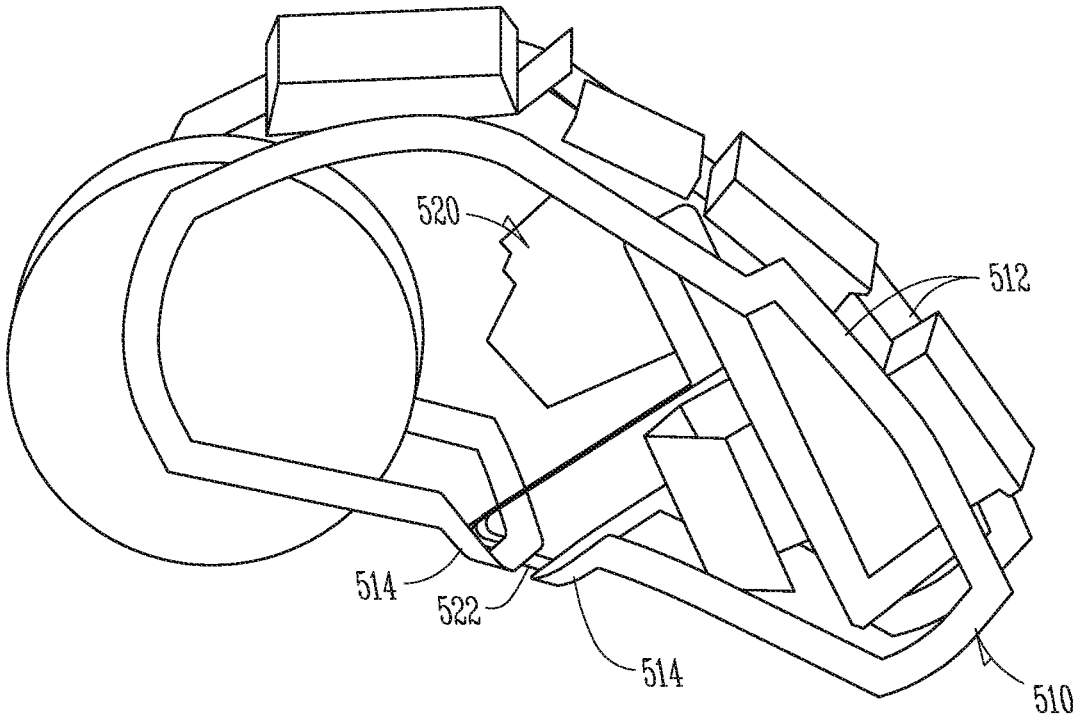
FIG. 6 is an illustration of an embodiment of portions of a hearing aid circuit including the antenna with the flared cross-feed.

For hearing aids using antenna 314 or an antenna similar to antenna 314, switching to antenna 514 has little or no impact on the mechanical foot print of the antenna. This represents an improvement that increases the antenna efficiency while decreasing the amount of capacitive loading seen by the antenna from the wearer's body when the hearing assistance device such as the hearing aid is worn. FIG. 6 is an illustration of an embodiment of portions of a hearing aid circuit 520 including antenna 510 with the flared cross-feed 514. Hearing aid circuit 520 represents an embodiment of hearing aid circuit 320 with antenna 310 replaced by antenna 510.

While illustrated in FIGS. 1-6 with an antenna in a BTE type hearing aid as a specific example, the present subject matter is applicable for any antennas that may interfere with human body or other object in their use and are therefore subject to various loading effects. The present subject matter is also applicable for any antenna types including, but not limited to dipoles, monopoles, patches, and combinations of such types. The application of the present subject matter eliminates the use of certain hearing aid circuit components such as a tuning circuit that can be adjusted for individual wearers and/or environments, and prevents the hearing aid from failing to be tuned for one or more necessary operating frequencies for its wireless communication. In various embodiments, the present subject matter facilitates miniaturization of wireless hearing aids and improves antenna performance by reducing deteriorating effects of human body loading.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing assistance devices that are configured to communicate with mobile phones. In such embodiments, the hearing assistance device may be operable to perform one or more of the following: answer incoming calls, hang up on calls, and/or provide two way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, headphones, and similar hearing devices.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing device configured to be worn by a wearer having an ear, comprising:

a circuit configured to perform wireless communication;

an antenna including two antenna elements and a cross-feed coupled directly between the two antenna elements, the cross-feed providing for electrical connection directly between the two antenna elements and including one or more bends configured to reduce capacitive coupling between the antenna and the wearer;

an antenna feed coupled between the antenna and the circuit to provide for electrical connection between the antenna and the circuit; and a case housing the circuit, the antenna, and the antenna feed.

2. The hearing device of claim 1, wherein the one or more bends comprises a plurality of bends.

3. The hearing device of claim 1, comprising a behind-the-ear (BTE) type hearing aid including the circuit, the antenna feed, the antenna, and the case, wherein the case is configured to be worn behind the ear or over the ear.

4. The hearing device of claim 3, wherein the two antenna elements comprise two antenna loops, and the cross-feed comprises two cross-feed lines each coupled directly between the two antenna loops.

5. The hearing device of claim 4, wherein the two antenna loops are approximately symmetric and positioned in parallel.

6. The hearing device of claim 5, wherein the antenna comprises a butterfly antenna.

7. The hearing device of claim 4, wherein the antenna comprises a flex circuit antenna including a conductor trace forming the two antenna loops and the two cross-feed lines on a flex circuit substrate.

8. The hearing device of claim 3, wherein the two cross-feed lines each comprise a portion approximately perpendicular to each loop of the two antenna loops, and the one or more bends comprise bends forming approximately 90-degree turns at each connection between a line of the two cross-feed lines and a loop of the two antenna loops.

9. A hearing device configured to be worn by a wearer having an ear, comprising:

a circuit configured to perform wireless communication;

an antenna feed coupled to the circuit;

an antenna coupled to the circuit via the antenna feed and including:

two antenna loops;

two cross-feed lines each coupled directly between the two antenna loops and coupled directly to the antenna feed, the two cross-feed lines each providing for an electrical connection directly between the two antenna loops; and a plurality of bends formed by at least each line of the two cross-feed lines to reduce capacitive coupling between the antenna and the wearer; and a case housing the circuit, the antenna feed, and the antenna.

10. The hearing device of claim 9, wherein the plurality of bends is formed by each line of the two cross-feed lines and a portion of a loop of the two antenna loops.

11. The hearing device of claim 10; wherein the plurality of bends comprises two approximately 45-degree bends.

12. The hearing device of claim 10, wherein the antenna comprises a flex circuit antenna including a conductor trace forming the two antenna loops and the two cross-feed lines.

13. The hearing device of claim 12, wherein the two antenna loops are approximately symmetric and positioned in parallel.

14. The hearing device of claim 13, comprising a behind-the-ear (BTE) type hearing aid including the circuit, the antenna feed, the antenna, and the case.

15. A method for wireless communication to be performed by a hearing device configured to be worn by a wearer having an ear, comprising:

providing an antenna including two antenna elements and a cross-feed connected directly between the two antenna elements, the cross-feed providing for electrical connection directly between the two antenna elements;

reducing capacitive coupling between the antenna and the wearer by configuring the cross-feed to include one or more bends; and connecting the antenna to a circuit using an antenna feed configured to connect the cross-feed to the circuit, the circuit configured to perform the wireless communication.

16. The method of claim 15, wherein providing the antenna comprises providing two antenna loops as the two antenna elements and providing two cross-feed lines as the cross-feed, the two cross-feed lines each coupled directly between the two antenna loops and including a plurality of bends of the one or more bends.

17. The method of claim 16, comprising constructing the antenna as a conductor trace on a flex circuit substrate.

18. The method of claim 17, comprising placing the two loops in parallel in the hearing device.

19. The method of claim 18, comprising housing the antenna, the circuit, and the antenna feed in a case of a hearing aid, the hearing aid being the hearing device.

20. The method of claim 19, wherein the case is configured to be worn behind or over the ear.

* * * * *